US007194935B1

(12) United States Patent
Li

(10) Patent No.: US 7,194,935 B1
(45) Date of Patent: Mar. 27, 2007

(54) HEXAGONAL DRIVING TOOL WITH PAWL PIECE

(76) Inventor: Hsi-Yung Li, No.48, Lane 347, Tucheng Rd., Dali City, Taichung County 412 (TW)

( * ) Notice: Subject to any disclaimer, the term of this patent is extended or adjusted under 35 U.S.C. 154(b) by 0 days.

(21) Appl. No.: 11/435,490

(22) Filed: May 16, 2006

(51) Int. Cl.
*B25G 3/18* (2006.01)
*B25B 23/10* (2006.01)

(52) U.S. Cl. ..... 81/177.85; 81/53.2; 81/436; 81/448

(58) Field of Classification Search ..... 81/177.85, 81/177.5, 53.2, 436, 437, 441–444, 448–455, 81/460, 461, 125, 186, 185.1, 185.2
See application file for complete search history.

(56) References Cited

U.S. PATENT DOCUMENTS 1,275,810 A * 8/1918 White ..... 81/443
4,060,114 A * 11/1977 Matsushima ..... 81/448
4,602,534 A * 7/1986 Moetteli ..... 81/177.85
7,017,457 B2 * 3/2006 Nessbaum et al. ..... 81/177.85
7,137,322 B2 * 11/2006 Mark et al. ..... 81/436
2005/0115370 A1 * 6/2005 Totsu ..... 81/452

* cited by examiner

*Primary Examiner*—Hadi Shakeri
(74) *Attorney, Agent, or Firm*—Charles E. Baxley

(57) ABSTRACT

A hexagonal driving tool includes a socket having a reception hole and the socket is connected with a hand tool. A hexagonal driving rod has a first end inserted in the reception hole and a groove is defined longitudinally in the hexagonal driving rod. A recess is defined transversely in the hexagonal driving rod and communicates with the groove. An elongate pawl piece is received in the groove and a first spring is located between the pawl piece and an inner surface of the recess. The first spring pushes one of two sides of the pawl piece out from the groove so as to be engaged with a rounded corner of a rounded hexagonal recess in the head of a bolt or screw.

6 Claims, 9 Drawing Sheets

HEXAGONAL DRIVING TOOL WITH PAWL PIECE

FIELD OF THE INVENTION

The present invention relates to a hexagonal driving tool for rotating a bolt with a rounded hexagonal recess in its head.

BACKGROUND OF THE INVENTION

A conventional way to rotate a bolt or a screw with a head is to use a wrench or a socket, the wrench has an open clamping space so that the hexagonal head of the bolt of screw is clamped by two jaws of the wrench. At least two sides of the hexagonal head can be clamped by the jaws and when the wrench is rotated, the bolt or screw is rotated. A similar way for the socket or a box-end wrench to rotate the bolt or screw. Another type of bolt or screw has a round head with hexagonal recess defined in the head, a hexagonal driving tool is needed to rotate this type of bolt or screw. The hexagonal driving tool is sized such that it can be inserted and engaged with the hexagonal recess in the head of the bolt or screw, such that the bolt or screw can be rotated when rotating the hexagonal driving tool. Nevertheless, if the hexagonal recess is rounded, it is difficult to use the hexagonal driving tool to rotate the bolt or screw.

The present invention intends to provide a hexagonal driving tool which includes a hexagonal driving rod which has a groove for receiving a pawl piece therein, one side of the pawl piece is pushed by a spring out from the driving rod so as to be engaged with the rounded corner of the hexagonal recess such that the bolt or screw with the rounded hexagonal recess can be rotated.

SUMMARY OF THE INVENTION

The present invention relates to a hexagonal driving tool which includes a socket having a reception hole and a hexagonal driving rod has a first end inserted in the reception hole. The hexagonal driving rod has a groove defined longitudinally therein and a recess is defined transversely in the hexagonal driving rod and communicates with the groove. An elongate pawl piece is received in the groove and has a curved underside which matches with the groove. A first spring is located between the curved underside of the pawl piece and an inner surface of the recess so as to push one of two sides of the pawl piece out from the groove.

The primary object of the present invention is to provide a driving tool for rotating a bolt or screw with a rounded hexagonal recess, the driving tool includes a pawl piece which protrudes out from the hexagonal driving rod so as to engage with one of the rounded corners in the rounded hexagonal recess.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
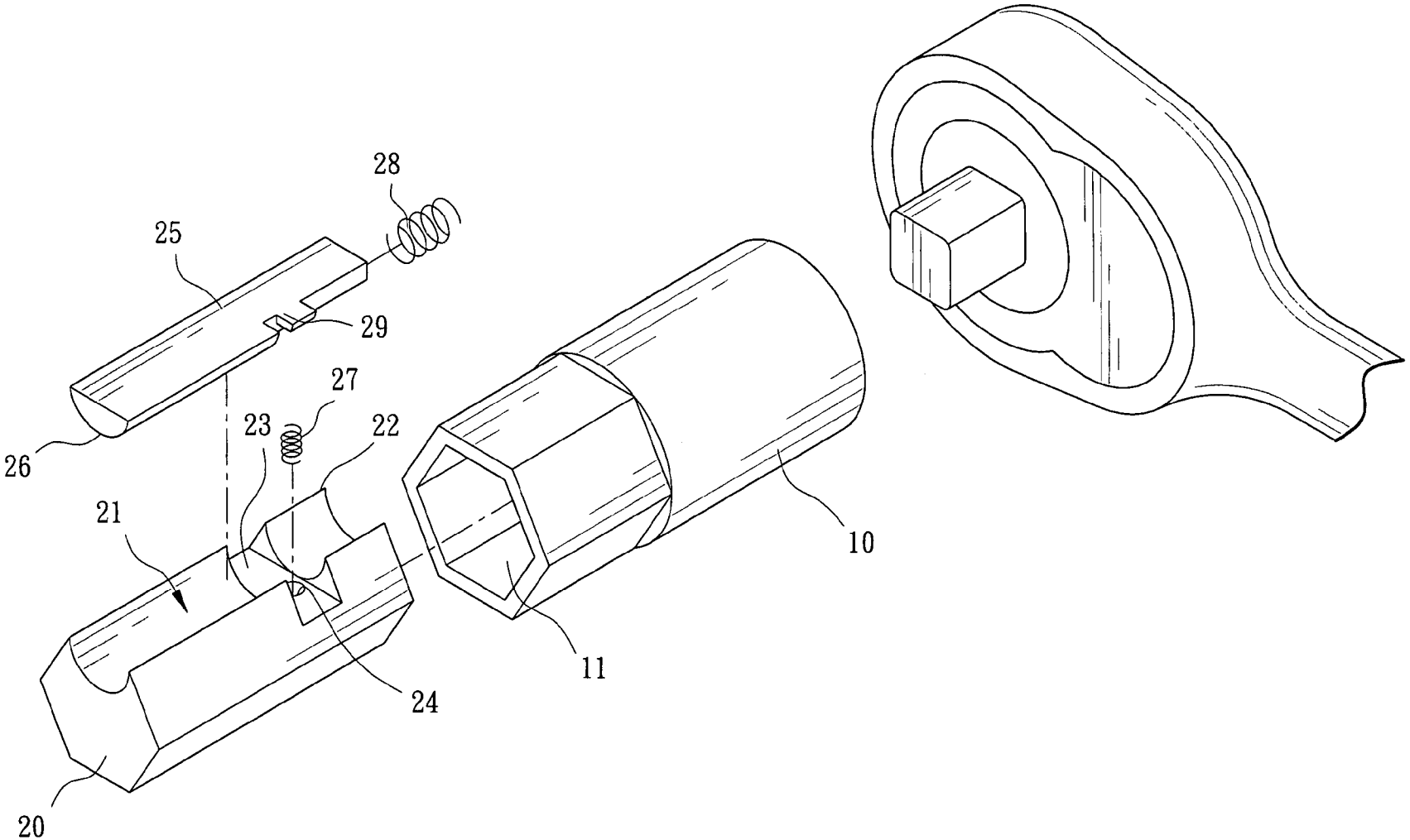
FIG. 1 is an exploded view to show the hexagonal driving tool of the present invention.
Figure 2:
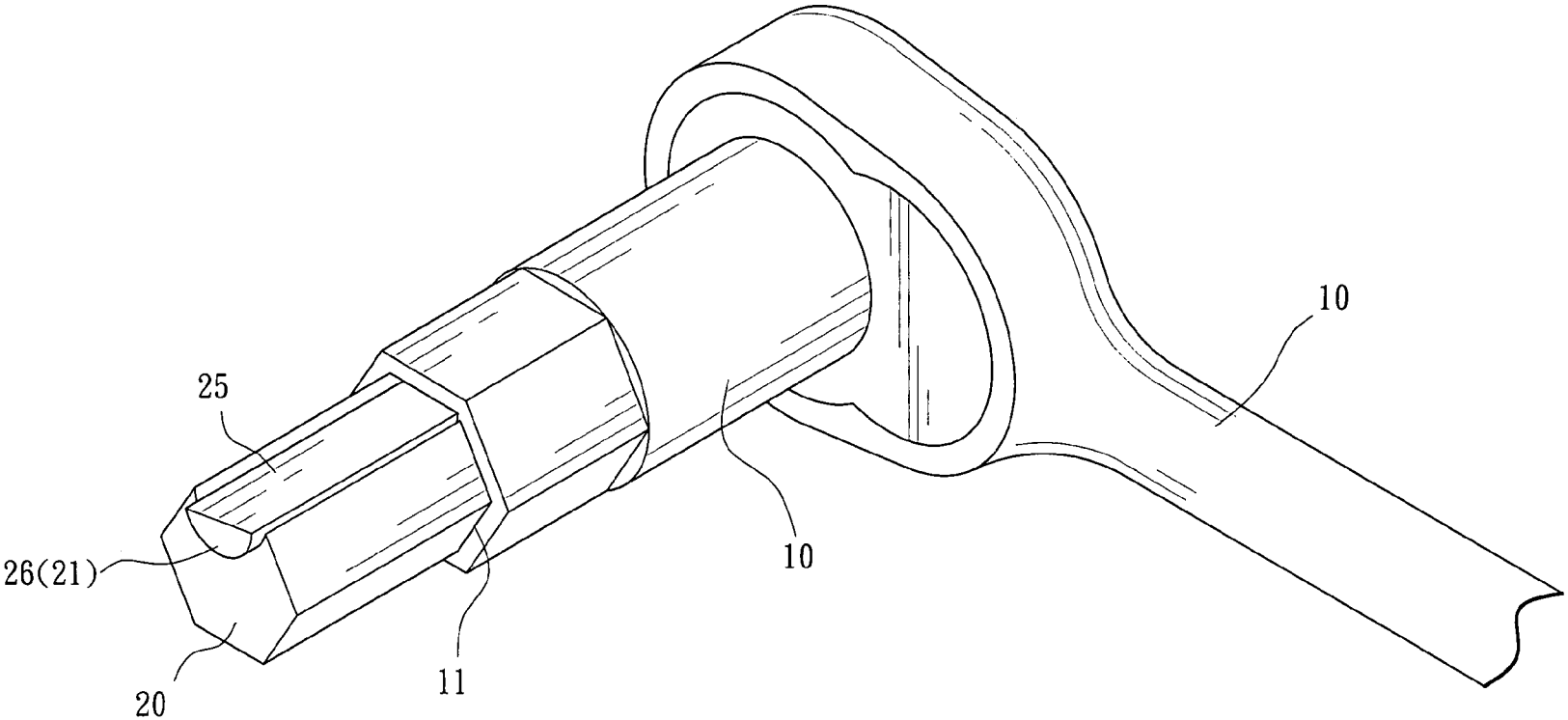
FIG. 2 is a perspective view to show the hexagonal driving tool of the present invention.
Figure 3:
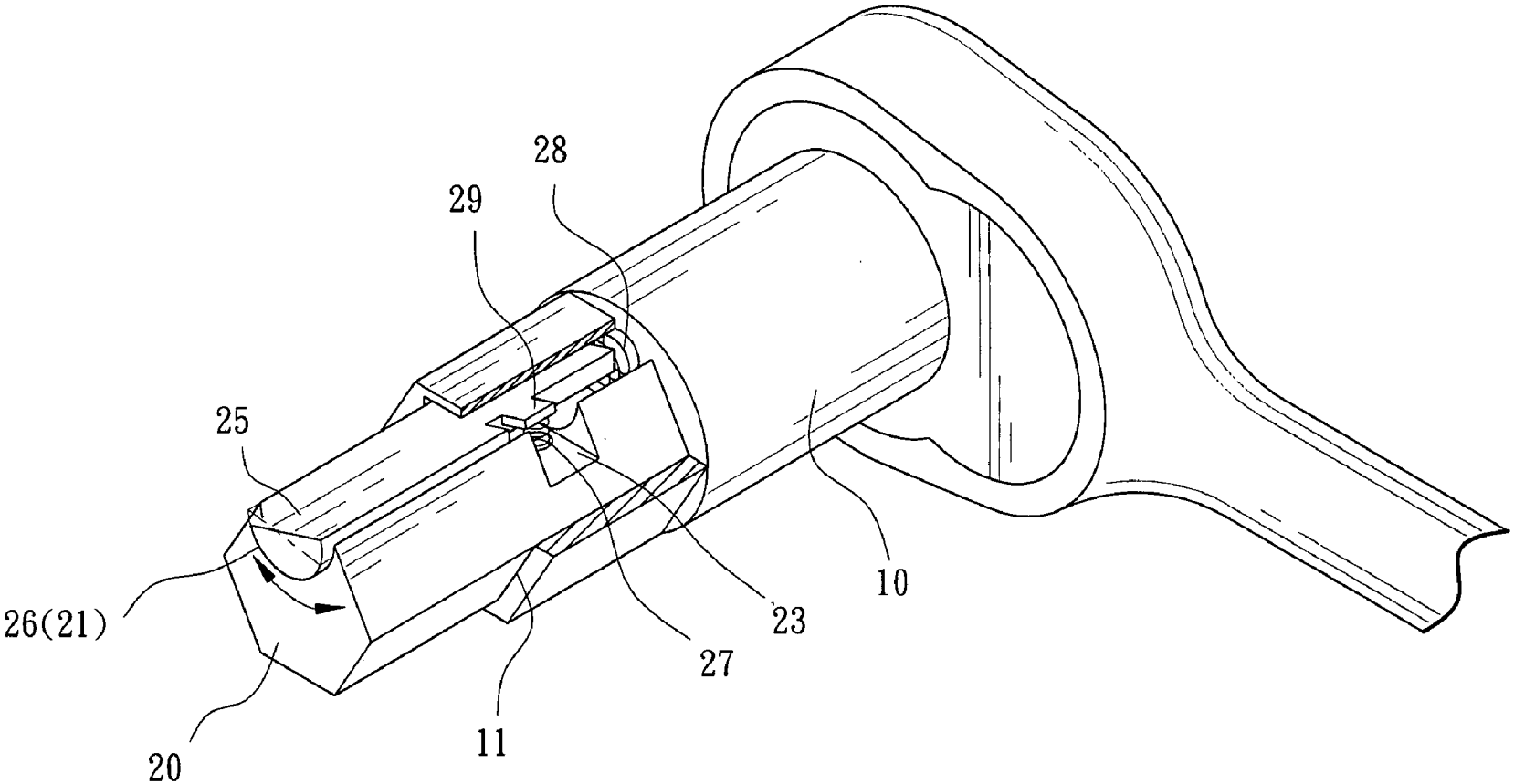
FIG. 3 is a perspective view to show that one of two sides of the pawl piece protrudes out from the hexagonal driving rod.
Figure 4:
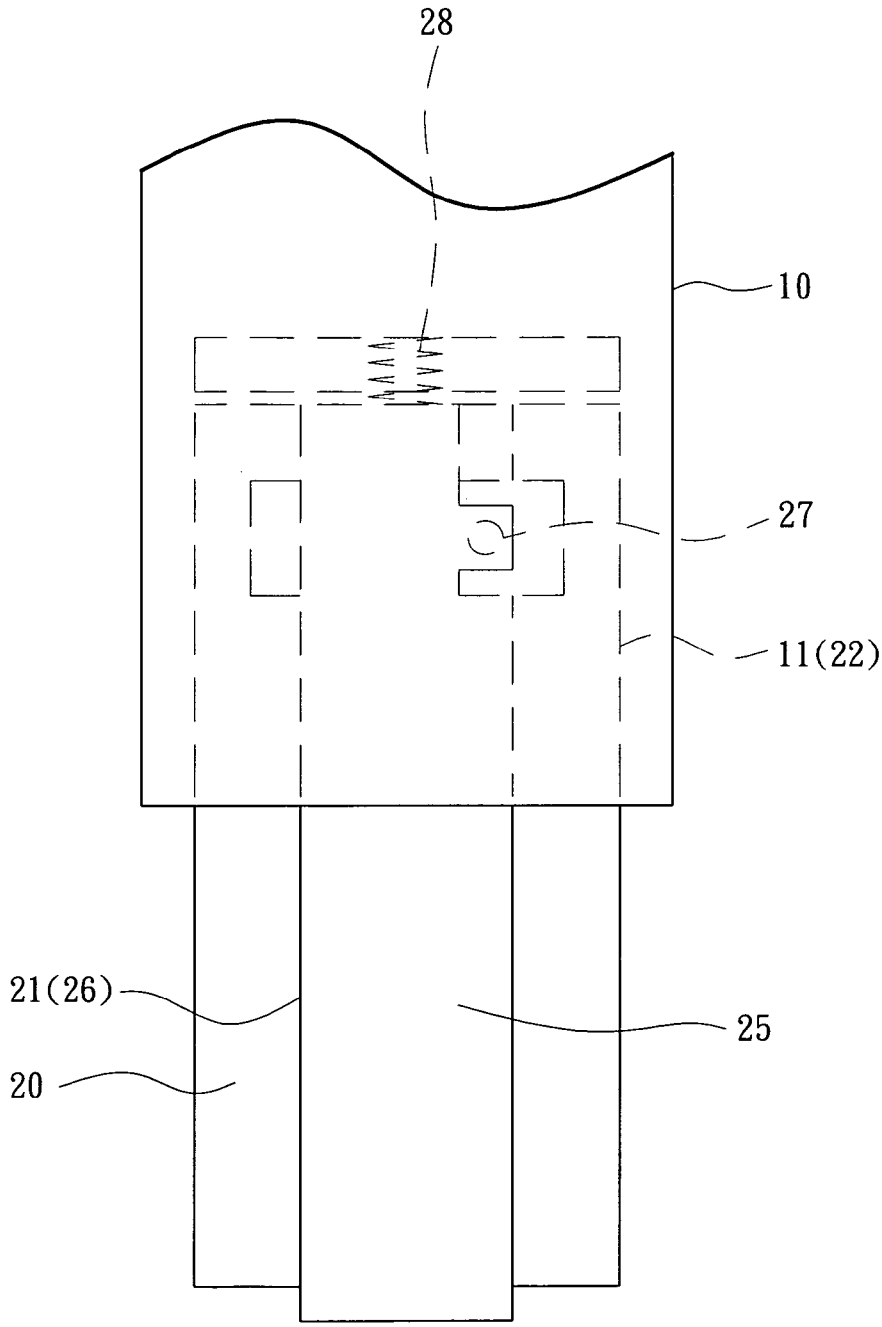
FIG. 4 shows that an end of the hexagonal driving tool protrudes out from the distal end of the hexagonal driving rod.
Figure 5:
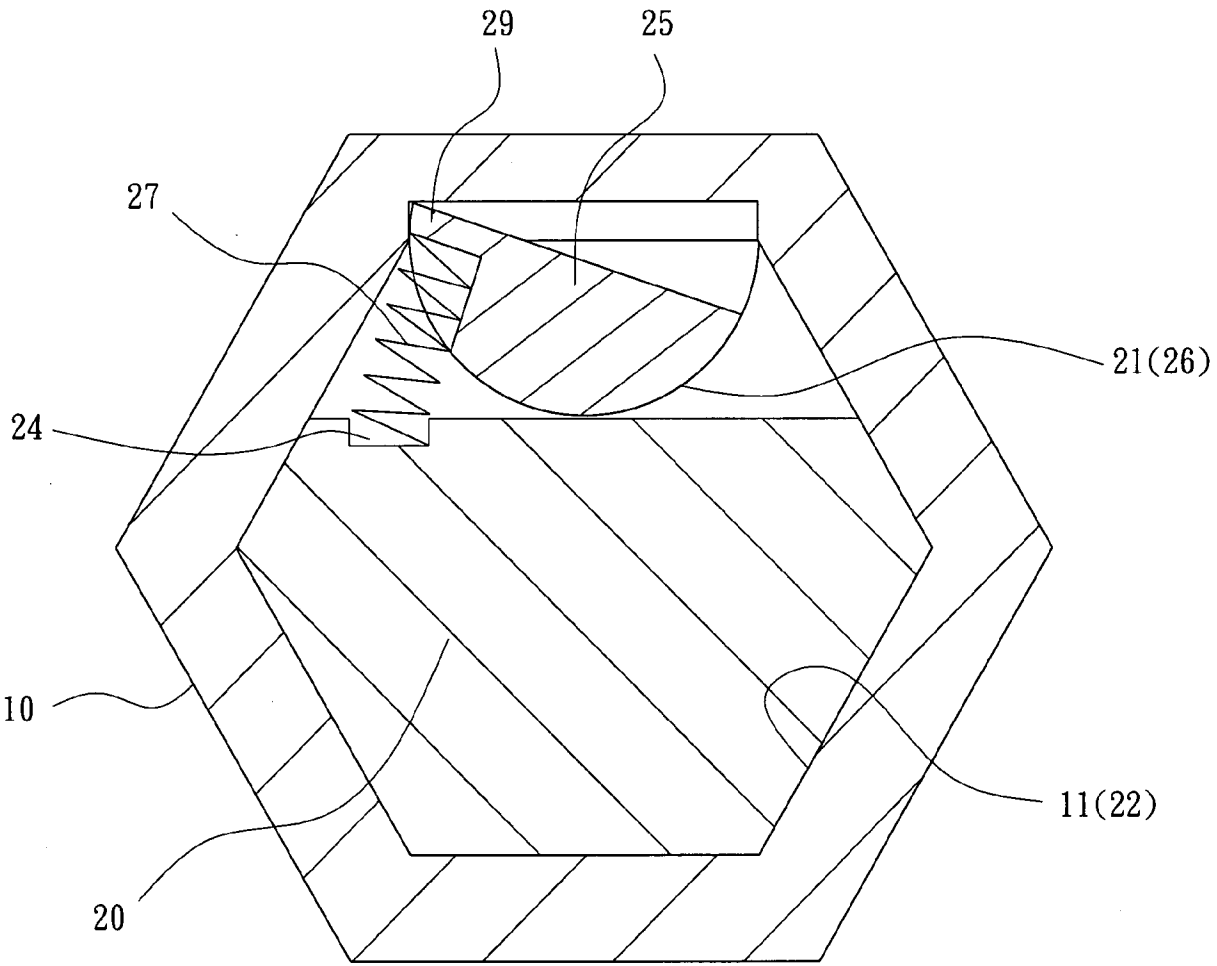
FIG. 5 is a cross sectional view to show that a side of the pawl piece is pushed by a first spring.

Referring to FIGS. 1 to 5, the hexagonal driving tool of the present invention comprises a socket 10 having a reception hole 11 defined therein and the socket 10 can be coopered with a ratchet tool. A hexagonal driving rod 20 has a first end 22 inserted in the reception hole 11 in the socket 10 and a groove 21 is defined longitudinally in the hexagonal driving rod 20. A recess 23 is defined transversely in the hexagonal driving rod 20 and communicates with the groove 21. An elongate pawl piece 25 is received in the groove 21 and has a curved underside which matches with the groove 21 and a flat top surface which intersects the curved underside so as to form two sides.

A dent 24 is defined in the inner surface of the recess 23 and a first spring 27 has one end engaged with the dent 24. The first spring 27 is located between the curved underside 26 of the pawl piece 25 and an inner surface of the recess 23. Two concavities are defined in the side of the pawl piece 25 so as to from a protrusion 29 located between the two concavities. The other end of the first spring 27 is in contact with the protrusion 29 so as to push one of the two sides of the pawl piece 25 out from the groove 21.

Figure 6:
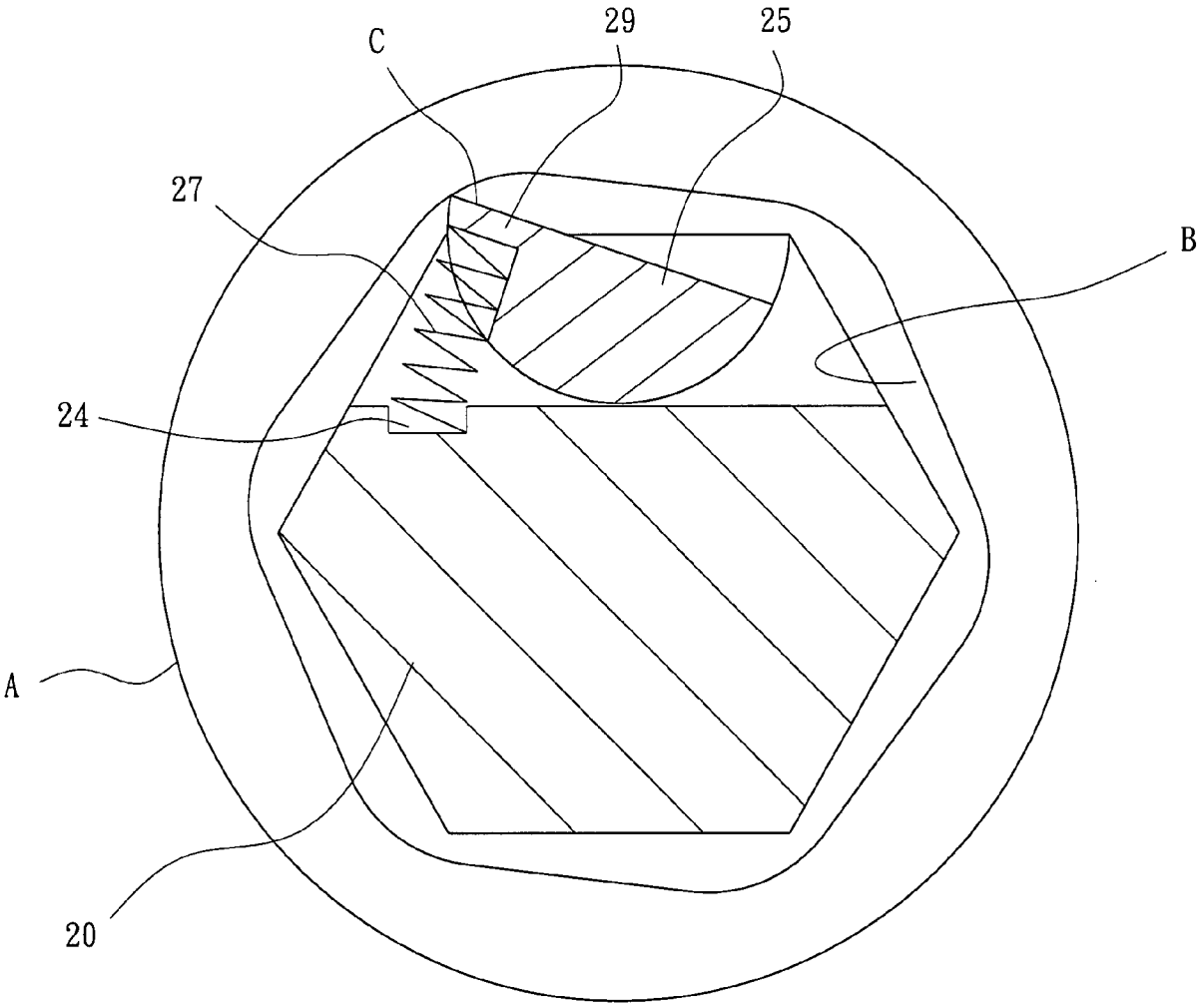
FIG. 6 is a cross sectional view to show that a side of the pawl piece is pushed by a first spring and engaged with one of the rounded corner of the rounded hexagonal recess.

A second spring 28 is located between the first end 22 of the pawl piece 25 and an inner surface of the reception hole 11 of the socket 10 such that a second end of the pawl piece 25 protrudes out from a distal end of the hexagonal driving rod 20. Referring to FIG. 6, the second end of the pawl piece 25 protruding from the distal end of the hexagonal driving rod 20 is convenient for the user to insert the second end of the pawl piece 25 into the hexagonal recess "B" of a bolt or screw "A". The side of the pawl piece 25 is then engaged with the rounded corner "C" of the hexagonal recess "B". When rotating the ratchet tool, the bolt or screw "A" can be rotated.

Figure 7:
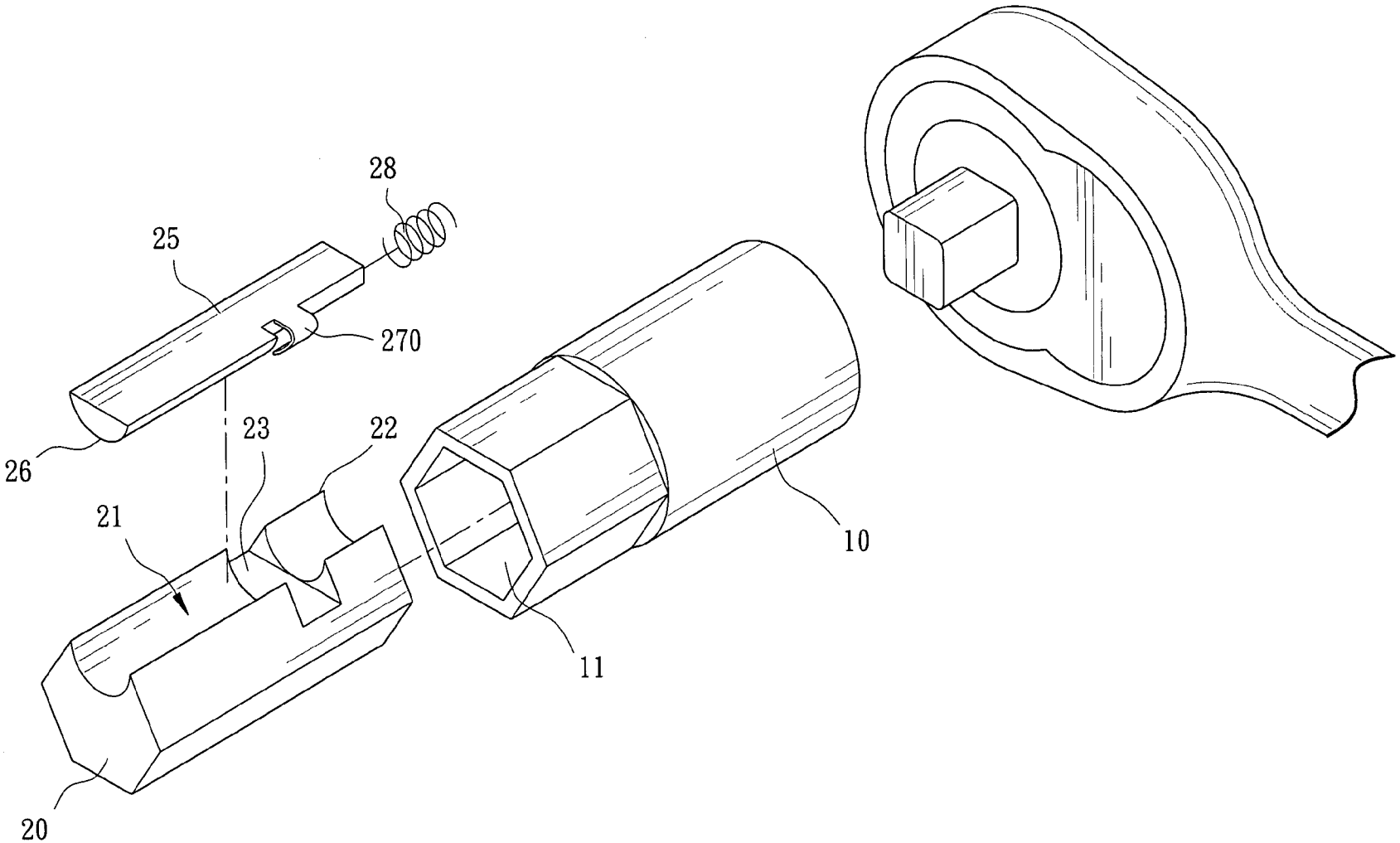
FIG. 7 shows that the first spring is integrally connected with the protrusion of the pawl piece.

FIG. 7 shows another embodiment of the first spring 270 which can be integrally connected with the protrusion 29 of the pawl piece 25. The first spring 270 is a plate with proper flexibility and one end of the first spring 270 is integrally connected with the protrusion 29 and the other end of the first spring 270 is in contact with the inner surface of the recess 23.

Figure 8:
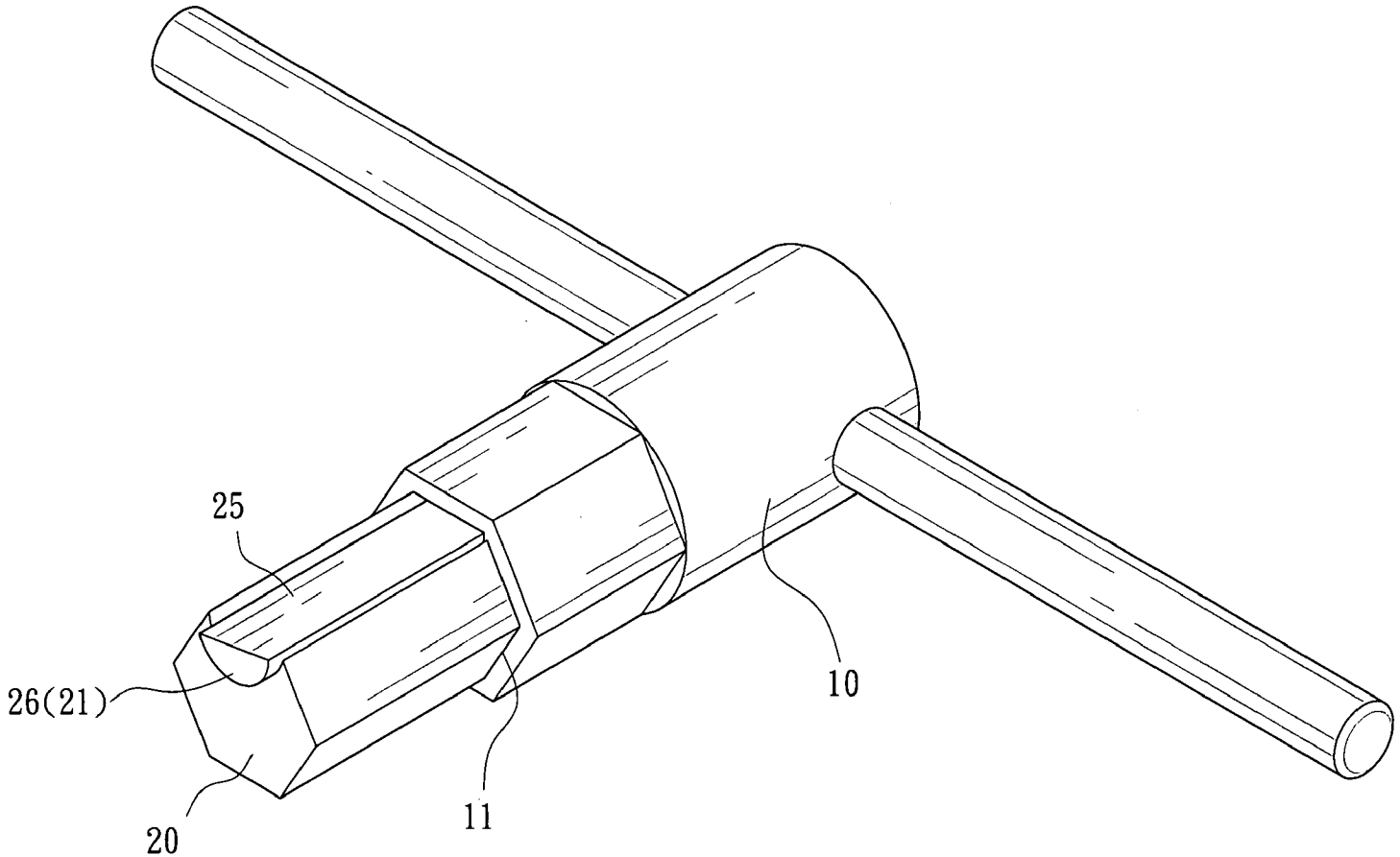
FIG. 8 shows that the socket is connected with a bar.
Figure 9:
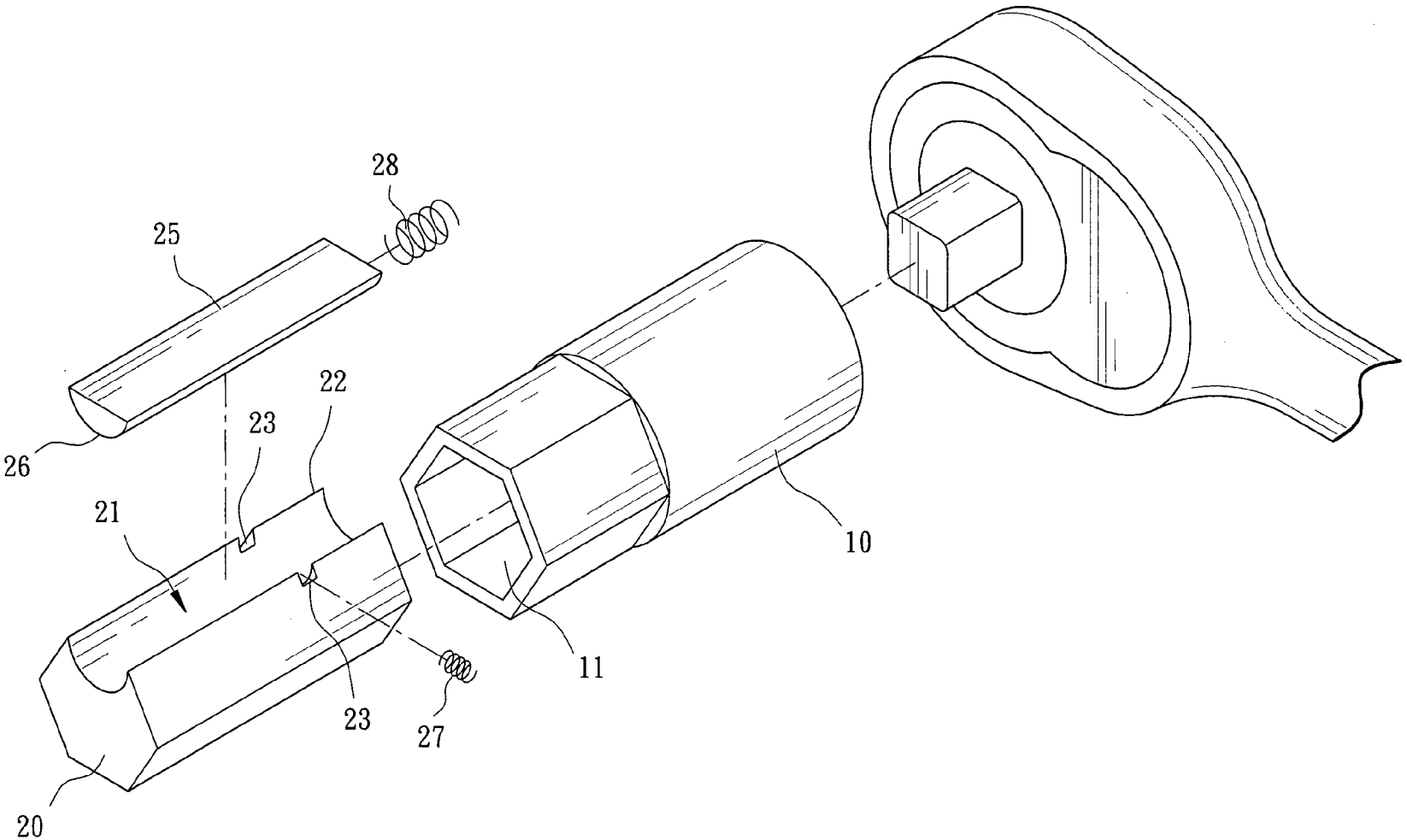
FIG. 9 is an exploded view to show another embodiment of the hexagonal driving tool of the present invention.

FIG. 8 shows that the socket 10 can be cooperated with a bar that extends transversely through the socket 10 to form a T-shaped mechanism for convenience of operation. FIG. 9 shows that the recess 23 in FIG. 1 is replaced by two recesses 23 defined in two sides along the groove 21 and the pawl piece 25 does not have the concavities, the first spring

27 is located in the groove 21 to push one of the two sides of the pawl piece 25 out from the groove 21.

While we have shown and described the embodiment in accordance with the present invention, it should be clear to those skilled in the art that further embodiments may be made without departing from the scope of the present invention.

What is claimed is:

1. A hexagonal driving tool comprising:

a socket having a reception hole defined therein;

a hexagonal driving rod having a first end inserted in the reception hole in the socket, the hexagonal driving rod having a groove defined longitudinally therein and a recess defined transversely in the hexagonal driving rod, the recess communicating with the groove, and an elongate pawl piece received in the groove defining one side of said hexagonal driving rod and having a curved underside which matches with the groove, a first spring located between the curved underside of the pawl piece and an inner surface of the recess, the first spring pushing one of two sides of the pawl piece out from the groove.

2. The tool as claimed in claim 1, wherein a second spring is located between the first end of the pawl piece and an inner surface of the reception hole of the socket such that a second end of the pawl piece protrudes out from an end of the hexagonal driving rod.

3. The tool as claimed in claim 1, wherein a bar extends transversely through the socket.

4. The tool as claimed in claim 1, wherein a dent is defined in the inner surface of the recess and the first spring has one end engaged with the dent, two concavities are defined in the side of the pawl piece so as to from a protrusion located between the two concavities, the other end of the first spring is in contact with the protrusion.

5. The tool as claimed in claim 1, wherein the pawl piece includes a flat top surface which intersects the curved underside so as to form the two sides.

6. The tool as claimed in claim 4, wherein the first spring is a plate and one end of the first spring is integrally connected with the protrusion and the other end of the first spring is in contact with the inner surface of the recess.

* * * * *